US010174999B2

(12) United States Patent
Crafton et al.

(10) Patent No.: US 10,174,999 B2
(45) Date of Patent: Jan. 8, 2019

(54) SYSTEM FOR SUPPORTING CASTINGS DURING THERMAL TREATMENT

(71) Applicant: Consolidated Engineering Company, Inc., Kennesaw, GA (US)

(72) Inventors: Scott P. Crafton, Marietta, GA (US); Shanker Subramaniam, Marietta, GA (US); Paul Fauteux, Douglasville, GA (US); Andrew Turner, Marietta, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 153 days.

(21) Appl. No.: 15/268,656

(22) Filed: Sep. 19, 2016

(65) Prior Publication Data

US 2017/0082365 A1 Mar. 23, 2017

Related U.S. Application Data

(60) Provisional application No. 62/222,407, filed on Sep. 23, 2015.

(51) Int. Cl.
*F27D 5/00* (2006.01)

(52) U.S. Cl.
CPC ..... *F27D 5/00* (2013.01); *F27D 5/0006* (2013.01)

(58) Field of Classification Search
CPC ..... F27D 5/00; C21D 9/0025
USPC ..... 266/274
See application file for complete search history.

(56) References Cited

U.S. PATENT DOCUMENTS

| | | | | |
|---|---|---|---|---|
| 4,427,379 | A | 1/1984 | Duran et al. | |
| 5,271,967 | A | 12/1993 | Kramer et al. | |
| 5,770,165 | A * | 6/1998 | Truppi | B01D 53/34 110/244 |
| 6,224,693 | B1 | 5/2001 | Garza-Ondarza et al. | |
| 6,401,941 | B1 * | 6/2002 | Maumus | F27D 3/12 148/586 |
| 2004/0108092 | A1 | 6/2004 | Howard et al. | |
| 2009/0084470 | A1 * | 4/2009 | Kato | C21D 9/0025 148/225 |
| 2010/0236669 | A1 | 9/2010 | Meyer | |

(Continued)

OTHER PUBLICATIONS

International Search Report & Written Opinion dated Dec. 8, 2016, from PCT Application No. PCT/US2016/052408.

*Primary Examiner* — Scott R Kastler
(74) *Attorney, Agent, or Firm* — Louis Isaf; Womble Bond Dickinson (US) LLP

(57) ABSTRACT

A system for supporting castings during thermal treatments, such as solution heat treatment, quenching and aging, that includes a tray defining a horizontal base plane and having a plurality of tray openings therethrough, and a fixture extending over one or more of the tray openings. The fixture is formed by a plurality of support plates oriented vertically with lower portions extending across the tray opening and top edges extending above the tray opening with shaped profiles along the lengths thereof. The plurality of support plates form an open lattice having a plurality of top edges that together define an open support surface that is substantially complementary with an underside surface of a casting and configured to loosely support the casting atop the lattice and align the casting in space above the tray opening.

24 Claims, 6 Drawing Sheets

(56) References Cited

U.S. PATENT DOCUMENTS

2015/0316323 A1* 11/2015 Hill ..... B65D 19/44
269/37
2017/0082365 A1* 3/2017 Crafton ..... F27D 5/00

* cited by examiner

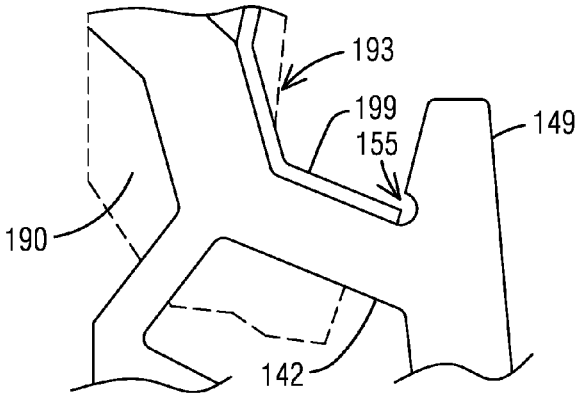
FIG. 5
FIG. 6
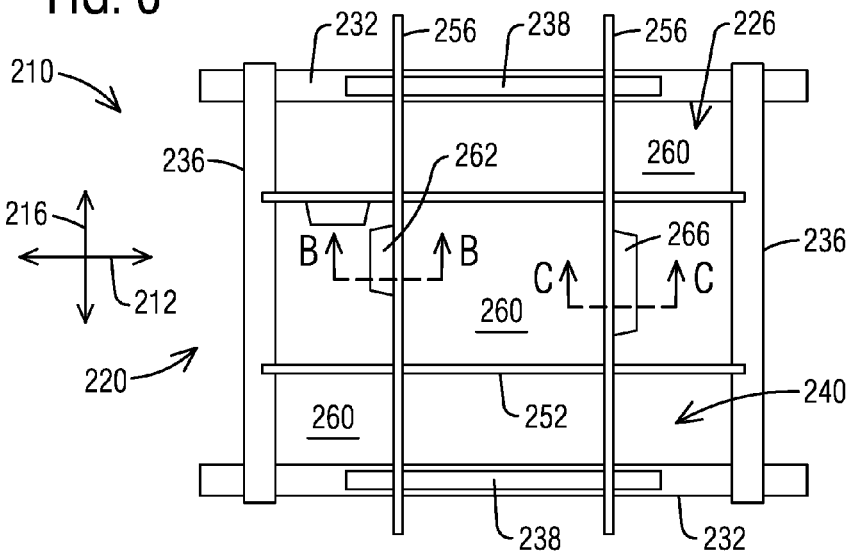
FIG. 7
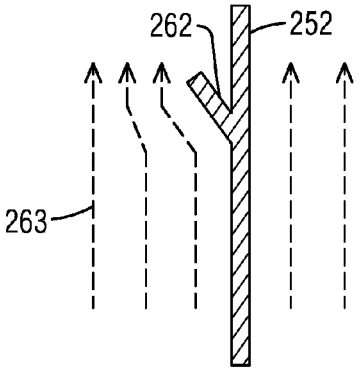
FIG. 8
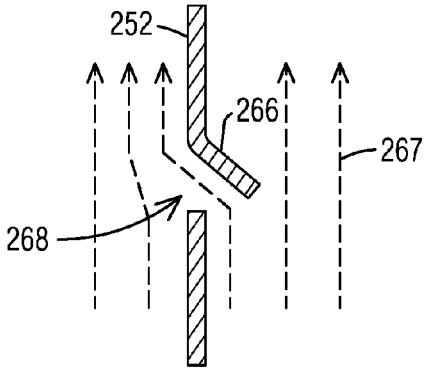

SYSTEM FOR SUPPORTING CASTINGS DURING THERMAL TREATMENT

CROSS-REFERENCE TO RELATED APPLICATIONS

This application claims the benefit of U.S. Provisional Patent Application No. 62/222,407 filed Sep. 23, 2015.

INCORPORATION BY REFERENCE

The disclosure of U.S. Provisional Patent Application No. 62/222,407 filed Sep. 23, 2015, is hereby incorporated by reference for all purposes as if presented herein in its entirety.

FIELD

The present invention relates generally to trays and fixtures for supporting castings during thermal treatments such as solution heat treatment, quenching and aging.

BACKGROUND

Historically, the thermal treatment of thin wall aluminum alloy castings that have been formed in high pressure die cast (HPDC) process is problematic and often results in defective parts and high scrap rates. For example, these types of castings often have complex shapes, surface features, apertures, and variations in their cross-sectional thickness that make it difficult to apply thermal treatments to the castings in a uniform manner. It has been found that unevenly-applied thermal treatments can often create large temperature gradients through the thickness or across the expanse of the alloy material during thermal treatment, resulting in dimensional distortions that remain set within the casting material after the thermal treatments are completed and the casting has returned to an ambient equilibrium temperature. In addition, the thin wall sections of the casting can also be particularly prone to distortion if not properly supported during thermal treatments that raise the temperature of the casting to highly-elevated levels, such as those applied during a solution heat treatment, that soften the alloy material and allow portions of the part to deflect or sag under its own weight. Whether caused by temperature gradients or sagging, if the dimensional distortion of the casting after thermal treatment exceeds predetermined tolerances, the casting is generally scrapped.

Previous attempts to control the sagging created during solution heat treatments include full position fixtures, not shown but known to one of skill in the art, that are tightly or with close tolerances clamped around the castings shortly after their removal from the die, and which then travel with the castings throughout the thermal treatments to rigidly constrain the castings to reduce sagging and other thermal distortions that could pull the metallic parts out of dimensional tolerance. By their very presence, however, the full position fixtures can often impede or block the flow of thermal fluids to portions of the casting material, thereby exacerbating the temperature gradients across the expanse of the part. This can lead to the formation of internal stresses that cause the castings to spring out of shape when the full position fixtures are removed after the thermal treatments are completed.

SUMMARY

Briefly described, one embodiment of the present disclosure comprises a system for supporting castings during thermal treatments, such as solution heat treatment, quenching and aging, and the like, that includes a tray defining a horizontal base plane and having a plurality of tray openings therethrough. The system further includes a fixture extending over at least one of the tray openings and comprising a plurality of support plates oriented vertically with lower portions extending across the tray opening, and top edges extending above the tray opening having shaped profiles along the lengths thereof. In addition, the plurality of support plates form an open lattice having a plurality of top edges that together define an open support surface that is substantially complementary with an underside surface of a casting, and that is configured to loosely support the casting atop the lattice and orientate the casting in space above the tray opening.

Another embodiment of the disclosure includes a system for supporting castings during thermal treatments that includes a tray having a perimeter frame comprising a pair of side bars joined together by a pair of end bars to define a horizontal base plane, with at least one crossbar extending between the side bars intermediate the end bars to form a plurality of tray openings interior to the perimeter frame. The system further includes a fixture comprising a plurality of support plates oriented vertically, with lower portions that extend across a tray opening to engage at either end with the perimeter frame or with the at least one cross bar, and with top edges that extend above the tray opening with shaped profiles along the lengths thereof. In addition, each support plate intersects with at least one other support plate to form an open lattice having a plurality of top edges that together define an open support surface that is substantially complementary with an underside surface of a casting, and that is configured to loosely support the casting atop the lattice and align the casting in space above the tray opening

BRIEF DESCRIPTION OF THE DRAWINGS

FIG. 5 is a close-up of one end of the cross-sectional side view of FIG. 3.

FIG. 6 is a top view of a casting support system, in accordance with another representative embodiment.

FIG. 7 is a schematic cross-sectional side view of the casting support system of FIG. 6, as viewed from Section Line B-B.

FIG. 8 is a schematic cross-sectional side view of the casting support system of FIG. 6, as viewed from Section Line C-C.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present disclosure described herein.

DETAILED DESCRIPTION

The following description is provided as an enabling teaching of exemplary embodiments of a system for supporting castings during thermal treatments, also known as a casting support system. Those skilled in the relevant art will recognize that changes can be made to the embodiments described, while still obtaining the beneficial results. It will also be apparent that some of the desired benefits of the embodiments described can be obtained by selecting some of the features of the embodiments without utilizing other features. In other words, features from one embodiment or aspect may be combined with features from other embodiments or aspects in any appropriate combination. For example, any individual or collective features of method aspects or embodiments may be applied to apparatus, product or component aspects, or embodiments and vice versa. Accordingly, those who work in the art will recognize that many modifications and adaptations to the embodiments described are possible and may even be desirable in certain circumstances, and are a part of the invention. Thus, the following description is provided as an illustration of the principles of the embodiments and not in limitation thereof, since the scope of the invention is to be defined by the claims.

Illustrated in FIGS. 1-12 are several representative embodiments of a system for supporting castings during thermal treatments such as solution heat treatment, quenching and aging. As described below, the casting support system of the present disclosure can provide several significant advantages and benefits over other trays, fixtures or support systems that support and/or constrain castings, and in particular thin wall aluminum alloy castings formed in a high pressure die cast (HPDC) process, during thermal treatments. However, the recited advantages are not meant to be limiting in any way, as one skilled in the art will appreciate that other advantages may also be realized upon practicing the present disclosure.

Figure 1:
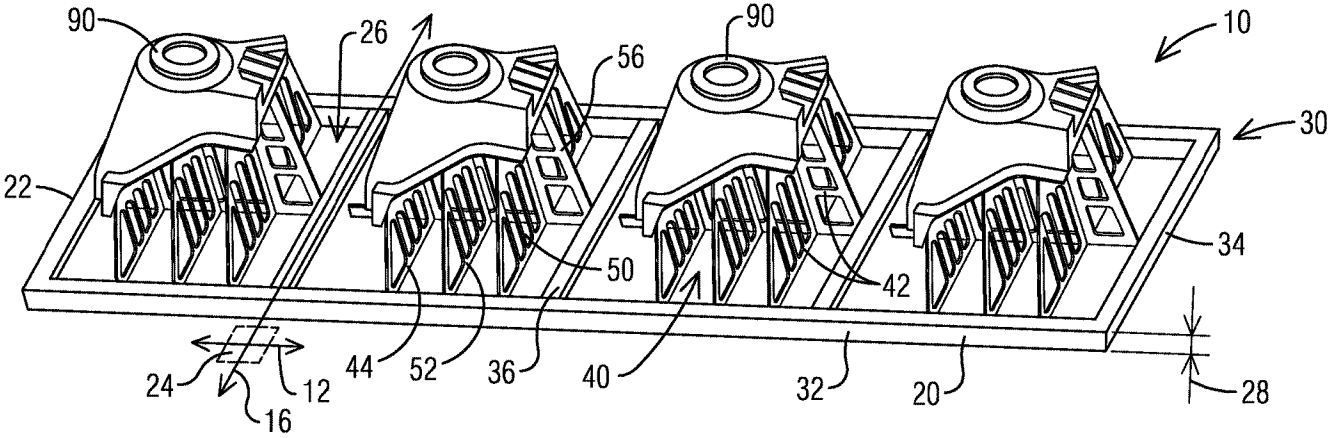
FIG. 1 is a perspective view of a casting support system and castings, in accordance with a representative embodiment of the present disclosure.

Illustrated in FIG. 1 is one embodiment of the casting support system 10 of the present disclosure that includes a base frame or tray 20 having a thickness and top surfaces 22 that define a horizontal base plane 24. The tray 20 also includes a plurality of vertically-aligned tray apertures or openings 26 through the thickness 28 of the tray that allow for thermal fluids such as heated air, cooling air, water, oil, and the like to pass unobstructed through the base plane 24 of the tray to impinge upon one or more castings 90 that are supported above the base plane 24. The thermal fluids can pass through the tray openings 26 before or after encountering the castings 90, depending on whether the thermal fluids are applied from below, from above, or laterally inward toward the sides of the castings. In one aspect the tray 20 can comprise a perimeter frame 30 having a pair or pairs of side bars 32 that are joined together by a pair of end bars 34 and one or more crossbars 36 extending between the side bars intermediate the end bars 34, and which together define the tray openings 26 interior to the perimeter frame 30. The various components that form the tray 20 can be manufactured from any suitable material, such as structural steel or another suitable material.

It will be appreciated that the tray 20 is generally configured to ride on chains, a roller conveyor, or similar transfer mechanism while carrying the castings 90 through one or more thermal treatment zones, such as a furnace, a quench system, an oven, or the like, to expose the castings to the thermal treatments. In some embodiments the tray 20 can be used within a continuous process in which multiple trays 20, each supporting a group of castings 90, are carried in sequence through the thermal treatment zones. In some aspects the tray 20 can ride directly on the rollers or chains, while in other aspects the tray can include an underlying support structure (not shown) that provides an interface between the transfer mechanism and the tray 20. In other embodiments where the thermal treatments are applied in discrete batch-type furnaces or quench systems, the trays 10 may be adapted for conveyance by robotic arms, fork lift trucks, shuttle carts, or similar manipulators that move the trays and groups of castings between thermal treatments.

The casting support system 10 further includes one or more fixtures 40 attached to the tray 20 that support and align the castings 90, such as the exemplary automotive vehicle shock towers 92 shown in the drawing, in space above one or more tray openings 26. Each fixture 40 generally comprises a plurality of support plates 42 that are oriented vertically with lower portions 44 that extend across the tray opening 26 and top edges 46 that extend above the tray openings 26, with the top edges 46 of the supports plates 42 having shaped profiles that extend along the lengths of the support plates. In one aspect each of the support plates 42 can intersect with at least one other support plate to form an open lattice 50 having a plurality of top edges that together define an open support surface that is substantially complementary or conforming with the underside surface of the casting 90, as shown in the drawing. In one aspect, the support plates 42 can include support plates 52 extending parallel to the longitudinal axis 12 of the base tray 220 and support plates 256 extending parallel to the width axis 16 of the base tray 20. However, in other aspects (not shown) the support plates may not intersect with one another, and instead can be aligned in another configuration, such as parallel, non-intersecting rows that are coupled together with beams or brackets, to define the open support surface. The various components that form the fixture 40, and especially the top edges of the support plates 42 that contact the casting 90, can be made from any suitable material, such as stainless steel or another suitable material.

Although not limited to any particular type of casting, the casting support system 10 of the present disclosure may be particularly suitable for supporting thin wall aluminum alloy castings that have been formed in a high pressure die cast (HPDC) process by reducing many of the problems associated with the thermal treatment of these parts. For instance, as described above, thin wall aluminum alloy HPDC castings often have unique and highly-complex shapes, surface features, apertures, and variations in their cross-sectional thickness in multiple directions that make it difficult to apply thermal treatments to the castings in a uniform manner. It has been found that unevenly-applied thermal treatments can often create temperature gradients through the thickness and/or across the expanse of the alloy material, resulting in dimensional distortions that remain set within the casting material after the thermal treatments are completed and the casting has returned to an ambient equilibrium temperature. Moreover, the thin wall sections of the casting can also be particularly prone to distortion if not properly supported during thermal treatments that raise the temperature of the casting to highly-elevated levels, such as those applied during a solution heat treatment, that soften the alloy material and allow portions of the part to deflect or sag under its own weight. Whether caused by temperature gradients or sagging, if the dimensional distortion of the casting after thermal treatment exceeds predetermined tolerances, the casting is generally scrapped.

The casting support system 10 of the present disclosure can overcome these problems by supporting each casting at key locations during high temperature solution heat treatments while still providing direct access by the thermal fluids to nearly all of the surfaces of the casting. In this way the casting support system 10 can prevent sagging while facilitating uniform and evenly-applied thermal treatments that reduce the internal temperature gradients across the treated part as the overall temperature of the part is being raised or lowered.

Figure 2:
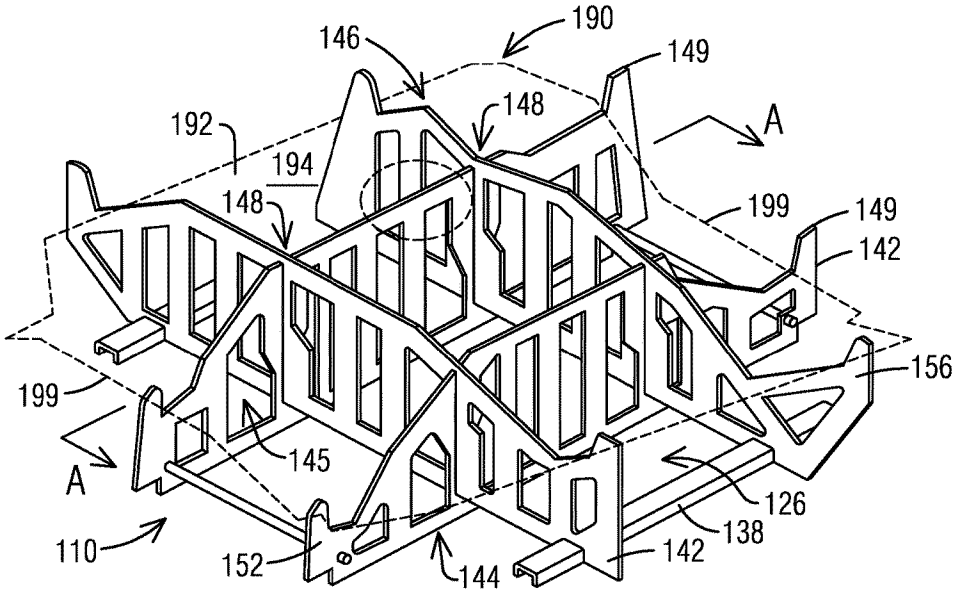
FIG. 2 is a perspective view of the casting support system and a casting shown in outline, in accordance with another representative embodiment.

For example, as shown with another representative embodiment illustrated in FIG. 2, the fixture 140 of the casting support system 110 can be individually customized to securely engage with and support a uniquely-shaped casting 190 (such as another thin wall aluminum alloy HPDC shock tower 192, shown in outline) in space above the tray opening 126. As stated above, the fixture 140 can support the casting 190 in a manner that allows the thermal fluids to have direct access to nearly all of the surfaces of the casting 190, and especially the underside surfaces 196 that might otherwise be blocked by the tray 120 or the fixture 140. In addition, the fixture 140 can also orientate the casting 190 in the space above the tray opening 126 to align portions of the casting's topside surfaces 194 and/or underside surfaces with the flow of the impinging thermal fluids, so as to better impart heat into or extract heat away from the alloy material of the casting 190 in a uniform manner.

Figure 3:
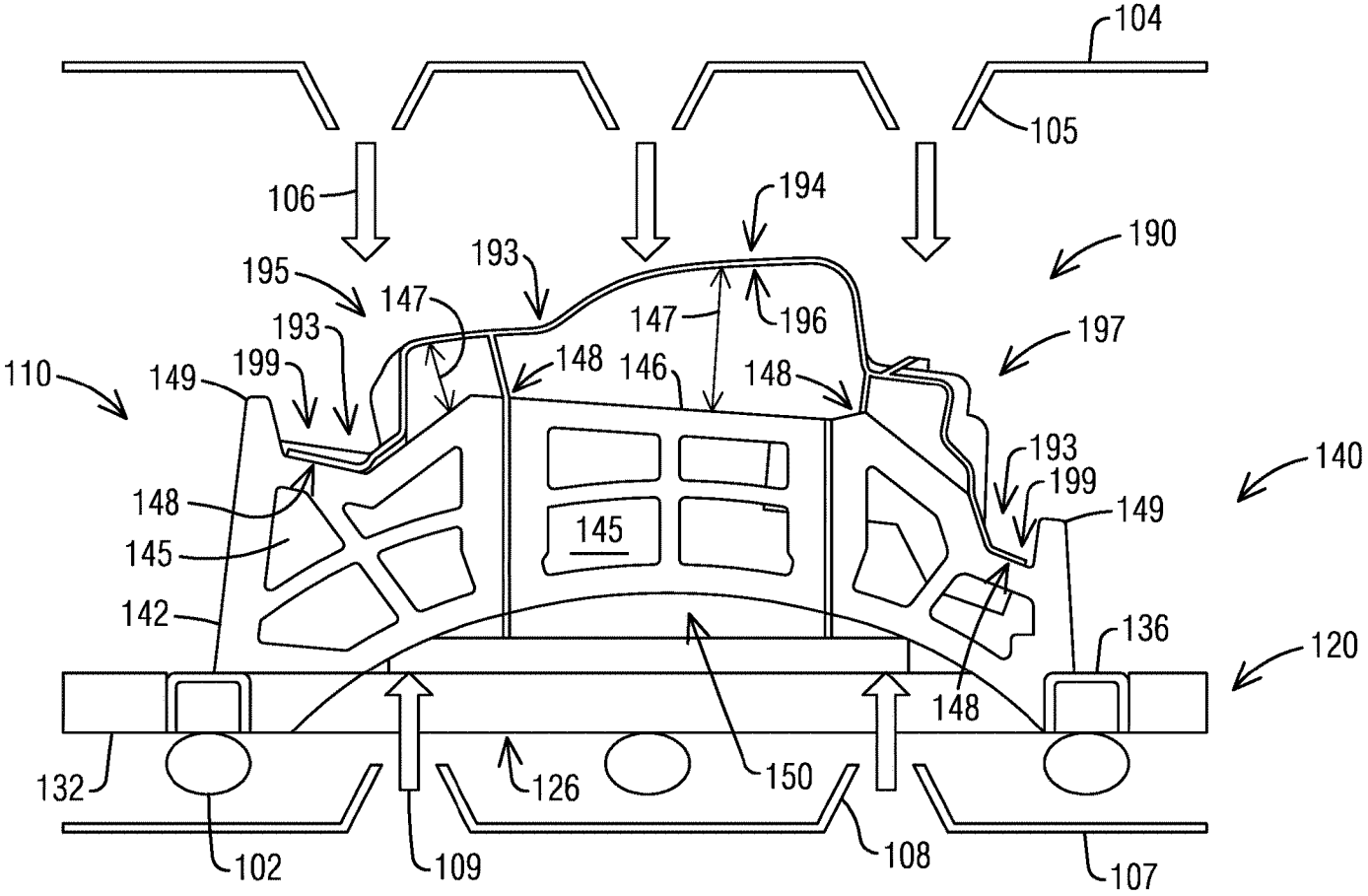
FIG. 3 is a cross-sectional side view of the casting support system and casting of FIG. 2, as viewed from section line A-A.

As illustrated in the cross-sectional side view of the casting support system 110 and casting 190 provided in FIG. 3, in some applications the casting 190 can include a highly-irregular and complex shape, as shown by the irregular profiles of the topside surface 194 and underside surface 196 along the length of the cross section. In addition, the thickness of the casting 190 between the topside and underside surfaces can also vary considerably along the cross section, resulting in thin-wall portions 193 that can be rapidly heated or cooled, and relatively thicker-walled portions 195 or structurally-dense and heavy portions 197 that require more heat input or extraction to achieve a targeted change in temperature. It will be appreciated that when a similar part is simply placed on a standard flat heat treatment tray having multiple small apertures formed therethrough, the heavier thick-wall portions of the casting can often be elevated and supported by thin-wall portions. Consequently, when the yield strength of the alloy material is reduced in a heat treatment process because of softening at solution temperature, the thin wall portions may not be sufficiently strong to support the weight of the heavier portions of the casting without deflection and deformation.

The casting support system 110 of the present disclosure can overcome this difficulty by independently supporting each section of the casting, including each of the heavy portions 197 or thick wall portions 195 as well as the thin wall portions 193, at key locations 148 across the underside of the casting 190. This can be accomplished by providing the top edges 146 of the support plates 140 with irregular shape profiles along their lengths that are at least partially complimentary with the irregular underside surfaces 196 of the casting. Once the support plates are assembled, and optionally interconnected, together to form the lattice 150, the plurality of top edges 146 of the lattice 150 define an open support surface that is substantially complementary with, although not necessarily conforming to, the underside surface 196 of the casting. As will be understood one of skill in the art, the support surface is "open" because it is not continuous, and instead is only defined by the top edges 146 of the support plates 142 that form a pattern or grid of narrow contact lines underneath the casting. The remainder, majority portion of the "surface" is imaginary and open to the polygonal-shaped flow areas or channels defined by the vertical support plates, and that can guide separate flows of thermal fluid upward from the tray opening 126 to the underside surface 196 of the casting 190.

The support surface defined by the plurality of top edges 146 of the support plates 142 can be substantially complimentary with the underside surface 196 of the casting 190 in that the casting may only fit atop the lattice 150, or become securely engaged by the lattice, in a single position. This engagement with the lattice can include multiple contact locations 148 having both vertical components that bear the weight of the castings and horizontal components that prevent the casting from moving or shifting laterally. Thus, once the casting 190 is settled into position atop the fixture 140, it can be securely maintained in that position as the casting tray 120 is moved through one or more thermal treatment sections and subjected to a variety of applied loads by the impinging thermal fluids. For example, the casting support system 110 can facilitate the use of directed streams of high velocity thermal fluids during thermal treatments, including but not limited to jets of high pressure air or water during a quench cycle, that would tend to reposition or shift parts that are less securely supported on a casting tray.

Nevertheless, even though the support surface defined by the plurality of top edges 146 of the support plates 142 may be substantially complimentary with the underside of the casting 190, it need not be exactly conforming with the underside surface 196 along the length of the support plates 142. The support surface can instead include discrete contact locations 148 separated by gaps 147 where the top edges 146 are spaced from the underside surface 196 by a distance that is sufficient to allow thermal fluids to flow between the two surfaces. In one aspect the contact locations 148 between the lattice 150 and the underside 196 of the casting 190 can be judiciously located at predetermined key locations across the expanse of the underside surface that would otherwise be prone to sagging or distortion if not directly supported by the fixture 140. In this way the casting 190 can be supported in space above the opening 126 using a reduced number of key contact locations 148, while leaving the remainder of the casting surfaces directly accessible by the thermal fluids.

Also shown in FIG. 3 is a stationary thermal treatment zone having an upper plenum 104 having downwardly-directed nozzles 105 or outlets for creating one or more downwardly-directed flows 106 of a thermal fluid (e.g. heated air in a heat treatment zone or cooling air in a quench zone) that impinge on the exposed topside surfaces 194 of the casting 190, as well as a lower plenum 107 having upwardly-directed nozzles 108 or outlets for creating one or more upwardly-directed flows 109 of the thermal fluid that impinge on the exposed underside surfaces 196 of the casting 190. In addition, the fixture 140 that supports the casting 190 is itself coupled to a tray 120 that is carried on the rollers 102 of a roller conveyance system through the thermal treatment zone. In one aspect both the downwardly-directed flows 106 and the upwardly-directed flows 109 can be substantially aligned with the thick-walled portions 195 and the structurally-dense portions 197 of the casting 190 so that more heat can be imparted into or extracted from these portions of the casing than the immediately adjacent thin-wall portions that require less heat transfer to achieve the same change in temperature. Furthermore, in one aspect the support surface defined by the plurality of top edges 146 of the support plates 142 can position and orientate the casting 190 in space to align the thick-walled portions 195 and the structurally-dense portions 197 with both sets of nozzles 105, 108. In addition, the upwardly-directed flows 109 of thermal fluid can pass substantially unimpeded through both the tray opening 126 and the lattice 150 of intersecting support plates 142 to impinge against the underside surfaces 196 of the casting 190.

Figure 4:
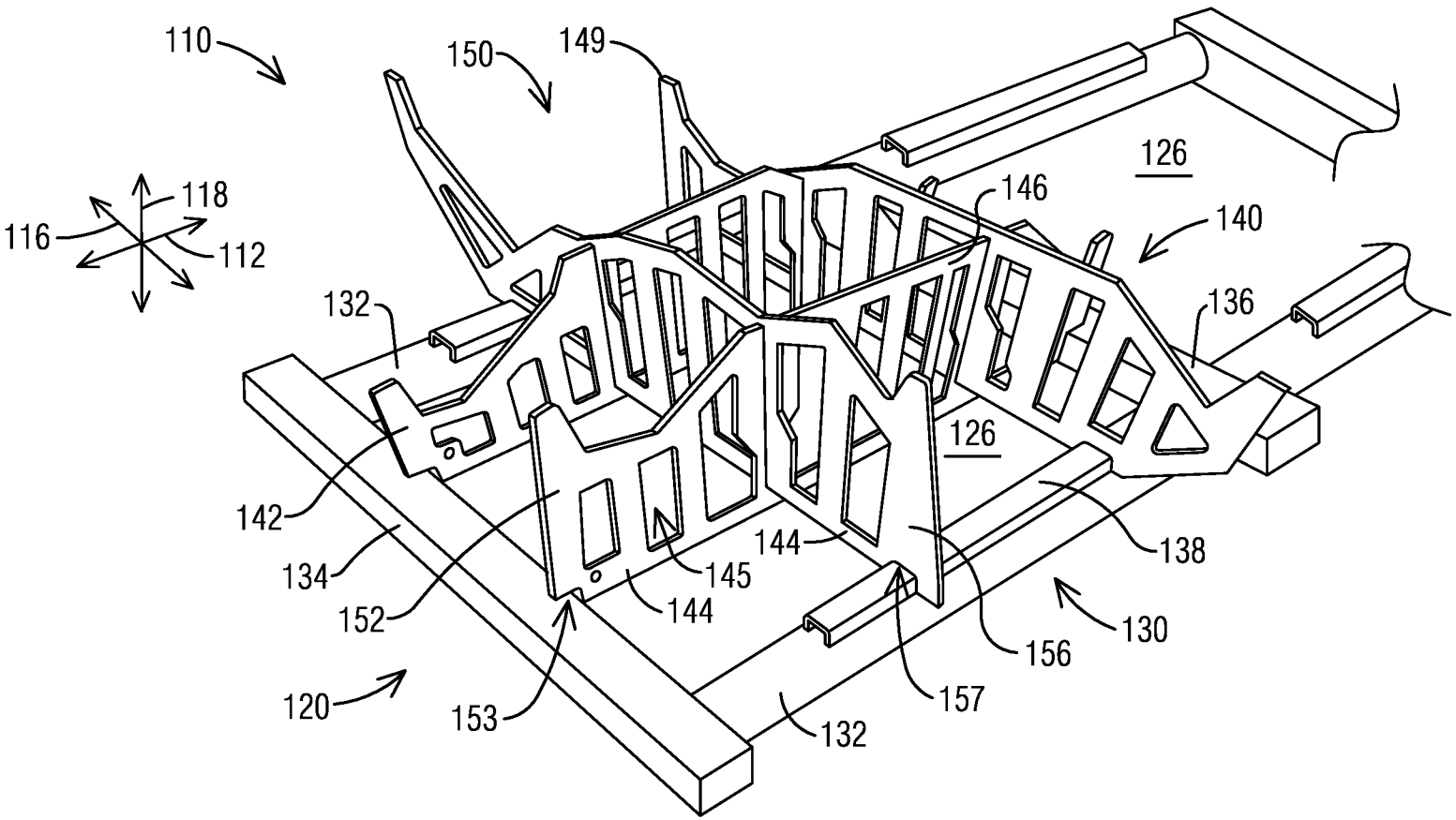
FIG. 4 is a perspective view of the casting support system of FIG. 2, as viewed from the opposite side.

FIG. 4 is a perspective view of the casting support system 110 of FIGS. 2-3 without the casting, and illustrates the fixture 140 that is formed by, in this case, four intersecting vertical support plates 142 mounted to the tray 120 above the tray opening 126. As can be seen, in this embodiment the perimeter frame 130 of the tray 120 can include multiple pairs of side bars 132 with cylindrical cross-sections, that are coupled at their ends to end bars 134 or crossbars 136 with rectangular cross-sections, and which together define a plurality of tray openings 126 interior to the perimeter frame 130. In one aspect the side bars 132, end bars 134 and crossbars 136 can be sized and configured together to form a standardized tray 120 that can serve as a base frame with standardized dimensions, so that a variety of differently-configured fixtures 140 can be removably and interchangeably mounted over the tray openings 126. In addition, the underside surfaces of the perimeter frame 130 and cross-bars 136 can ride directly atop the rollers 102 of the conveyance system (FIG. 3), and in one aspect can be removably coupled to each other to form a modular tray 120 that can be lengthened or shortened according to a desired application, and in which a damaged side bar or end bar/crossbar can be individually removed and replaced with an undamaged component without having to replace the entire tray 120

The fixture 140 of representative support system 110 can comprise four support plates 142 that are oriented vertically with lower portions 144 that extend across the tray opening 126 and top edges 146 that extend above the tray opening 126 and together form a lattice structure 150 in which the top edges 146 define the open support surface for the casting. In one aspect the support plates 142 can be substantially aligned with the major horizontal axes 112, 114 of the perimeter frame 130, with the lower edges 144 extending across the length or the width of the tray opening 126. In another aspect (not shown) the support plates can be aligned on the diagonal or at another angle relative the major horizontal axes of the perimeter frame 130. For the two support plates 152 of representative fixture 140 that are aligned parallel with the longitudinal axis 112 of the perimeter frame 130, the lower ends can terminate with notches 153 that engage the inner edges of the rectangular end bars 134 and crossbars 136, and may not extend across the centerlines of the crossbars 136 so as to not interfere with a fixture overlying the adjacent tray opening. For the two support plates 156 that are aligned parallel with the width axis 116 of the perimeter frame 130, the lower ends can extend outward past the side bars 132 and can include notches 157 formed into their lower edges that engage with mounting bars 138 that extend upward from the upper surfaces of the cylindrical side bars 132.

In one aspect the support plates 142 can intersect and connect with each other at predetermined locations defined by upwardly-opening half-slots formed into a lower pair of support plates 152 that mate with downwardly-opening half-slots formed into an upper pair support plates 156, as known in the art. In this way the support plates 142 of the fixture 140 can become interlocked together to form the lattice 150 prior to attachment to the tray 120. Furthermore, and as described in more detail below, the positions of the interlocking support plates 152, 156 within the lattice 150 can be modified relative to each other and to the surrounding structure of the tray 120 to position the contact locations 148 of the top edge 146 underneath the portions of the casting that require the most support. In the illustrated embodiment this can be accomplished by adjusting the locations of the half-slots along the lengths of the support plates, with the ends of the support plates being moved a corresponding distance along the end bars 134 or crossbars 136 or along the mounting bars 138 atop the side bars 132. Nevertheless, it will be appreciated that other connection methods or mechanisms for connecting the support plates 142 to each other and to the tray 120 are also possible and considered to fall within the scope of the present disclosure.

Also visible in FIGS. 2-4 are the plurality of apertures 145 that can be formed through the thickness of the support plates 142 that allow the thermal fluid to flow crossways through the support plates. As shown in FIGS. 2 and 4, in one aspect the apertures 145 can be elongated in the direction of the vertical axis 118 of the support system 110. This can result in a lattice support structure 150 that is largely "transparent" to the upwardly-directed flows of thermal fluid due to the minimal amount of flat surface areas and corners oriented perpendicular to the path of the thermal fluid that could obstruct its passage and diminish its velocity. In another aspect of the fixture 140 shown in FIG. 3, however, the apertures 145 in the vertically-aligned support plates can be elongated in the direction of the major horizontal axes 112, 116 of the support system 110. This can result in a support structure 150 with a much larger amount of flat surface area and corners oriented perpendicular to the path of the thermal fluid, thereby creating a greater degree of obstruction to the upwardly-directed flow of thermal fluid that can reduce its velocity while increasing its turbulence and mixing. It will be appreciated by a person of ordinary skill in the art that, depending on the application, both options could be used to provide for an improved transfer of heat into or away from the underside surfaces of the casting.

Castings 190 that are similar to the thin wall aluminum alloy HPDC shock tower 192 shown in FIGS. 2-3 can often include thin-wall projections of alloy material that project outwardly to define an outer edge 199 or flange (FIG. 3). These thin wall structures that are unsupported along one side can often be more susceptible to deflection or deformation during thermal treatments, and can therefore require a greater degree of support or constraint than other thin-walled internal sections of the casting that are substantially surrounded by alloy material. To provide this extra support, in one aspect the ends of the support plates 142 can include upwardly extending projections 149 that bound the outer edges 199 of the casting.

FIG. 5 is a close-up view of the left-side end of the support plate 142 of FIG. 2, and illustrates the upwardly extending projection 149 that bounds one outer edge 199 of the casting 190. In one aspect the lower inside edge of the projection 149 can include a notch 155 that is sized to receive the outer edge 199 of the casting after accounting for the thermal growth of both the casting and the support plate during a heat treatment. In addition, the top edge 146 of the support plate 142 can provide an extended line on contact at the contact location 148 along the underside surface 196 of the thin-wall portion 193 of the casting proximate the outer edge 199. It will be appreciated that both the extended line of contact that defines the proper position of the thin-wall portion 193 and/or the notch 155 that constrains the outer edge 199 from pulling upward during heat treatment can serve to maintain the alignment and prevent deformation of the outer edge portions of the casting during a plurality of thermal treatments.

The fixture 140 illustrated in FIGS. 2-4 can engage with the casting 190 along both the underside surfaces 196 and the outer edges 199 to securely support the casting 190 in a single position and to prevent it from accidently becoming dislodged from the fixture during thermal treatment. In other embodiments, such as casting support system 10 illustrated in FIG. 1, the fixture 40 can engage with the casting 90 primarily along its underside surfaces to securely support the casting in a single position, without necessarily engaging an outer edge.

FIG. 6 is a top view of another representative embodiment of the casting support system 210 that also includes a fixture 240 comprising four vertically-aligned and intersecting support plates, with two of the support plates 252 extending parallel to the longitudinal axis 212 of the base tray 220 and two support plates 256 extending parallel to the width axis 116 of the base tray 220. When assembled, the support plates 252, 256 together define nine polygonal shaped flow channels 260 that can guide flows of thermal fluid upward from the tray opening 226 to the underside surface of the casting (not shown). In this embodiment one or more support plates can also include a deflector 262, 266 that extends outward into a channel to redirect the flow of thermal fluid toward an opposing support plate. In one aspect the deflector 262 can extend outward and upward in the direction of the flow 263 to redirect the flow toward the opposite side of the same channel, as shown in the cross-sectional schematic view of FIG. 7. In another aspect the deflector 266 can extend outward and downward against the direction the flow 267 to redirect the flow through an aperture 268 in the support plate and toward the opposite side of an adjacent channel, as shown in the cross-sectional schematic view of FIG. 8.

Figure 9:
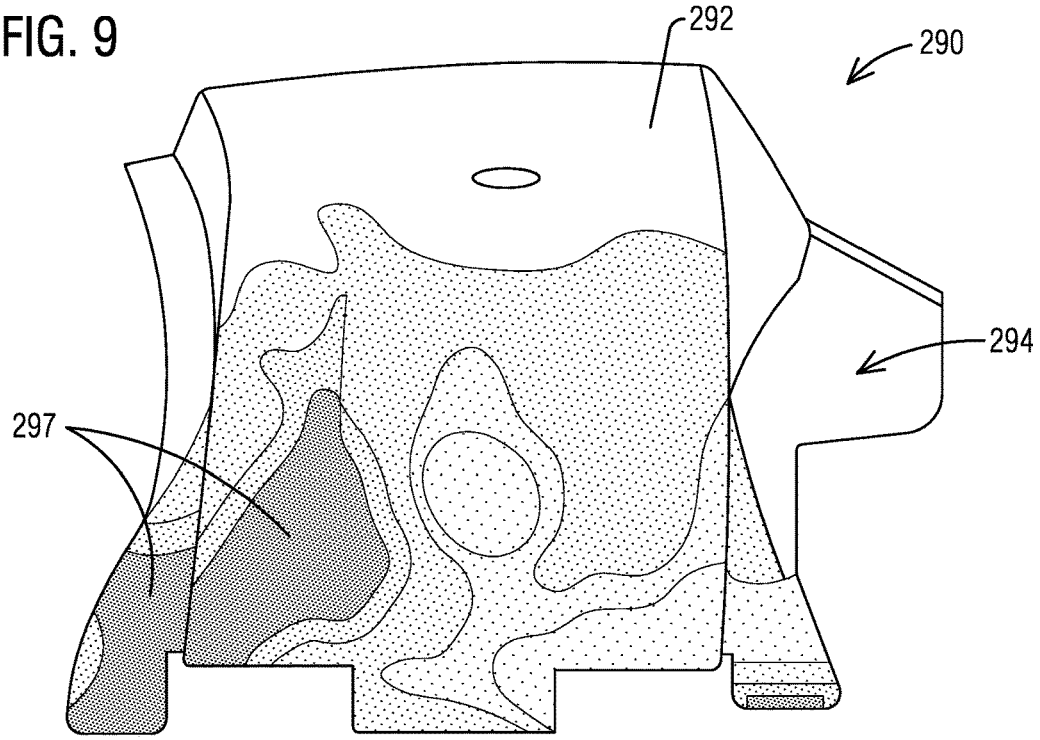
FIG. 9 is a schematic illustration of the dimensional distortions that may be present in a casting after thermal treatment.

In addition to the above-described benefits and advantages, the casting support system of the present disclosure can provide the user with additional options and flexibility in optimizing the support of any particular casting, including those with highly-irregular and complex shapes, so as to substantially reduce or eliminate dimensional distortions during thermal treatment. For example, the development of a new HPDC aluminum alloy casting can often include a set up period in which prototype castings formed with the new dies undergo a variety of thermal treatments to determine a preferred thermal treatment protocol that results in the highest yield of parts that meet end-user specifications. These protocols can often include solutionizing heat treatment, quenching and aging. With reference to FIG. 9, in one aspect accurate three dimensional measurements of the surfaces of the castings 290 can be captured first after removal from the die, and then again after passing through the thermal treatments. FIG. 9 illustrates the combination of these measurements in the form a contour map of a casting 290, in this case a thin wall aluminum alloy HPDC shock tower 292, in which an affected portion 297 of a surface 294 of the castings has experienced a substantial dimensional distortion. If this distortion is identified on a prototype casting part during the set up period as being caused by sagging, the fixture for the casting can then be modified to include an addition contact location between the top edge of the support plate and the casting 290 to better support the affected portion 297 during production runs. This could be accomplished by relocating a support plate or adding a new support plate underneath the affected portion, and/or by reshaping the top edge of a support plate that was already located beneath the affected portion.

Figure 10:
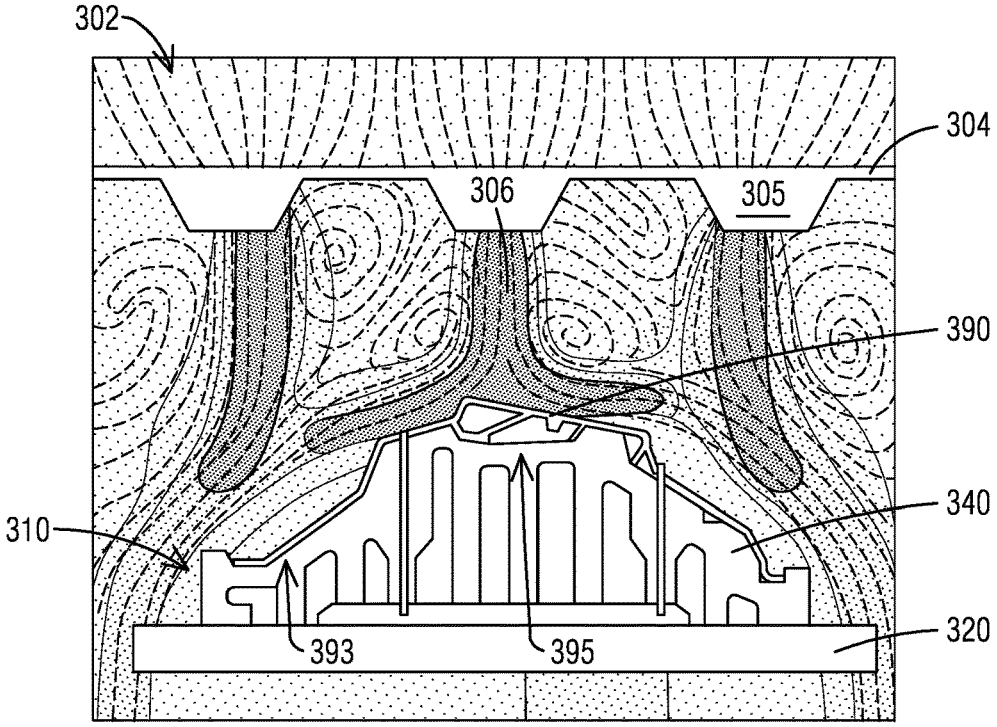
FIG. 10 is a cross-sectional schematic illustration of a flow of thermal fluid impinging on a casting that is carried by the casting support system of the present disclosure during a thermal treatment, in accordance with yet another representative embodiment.

Moreover, as shown in FIG. 10, in another aspect the casting 390, the casting support system 310, and a thermal treatment zone 302 could be modeled during development of the thermal treatment protocol to determine the flow pattern 306 of thermal fluids, such as heated hair or cooling air, around the casting 390 and the projected heat transfer rates across the surfaces of the casting. If it is determined that the heat transfer rates are improperly balanced between the thin wall portions 393 and thick wall portions 395 in a manner that would create temperature gradients through the thickness and/or across the expanse of the alloy material, then the fixture 340 for the casting 390 could be modified to adjust the position and/or orientation of the casting 390 within the flow pattern 306, or to improve or re-direct the flow pattern to the underside the casting using one or more deflectors. In this way the casting support system 310 can be used to facilitate uniform and evenly-applied thermal treatments that reduce the internal temperature gradients across the treated casting 390 as the overall temperature of the part is being raised or lowered.

Figure 11:
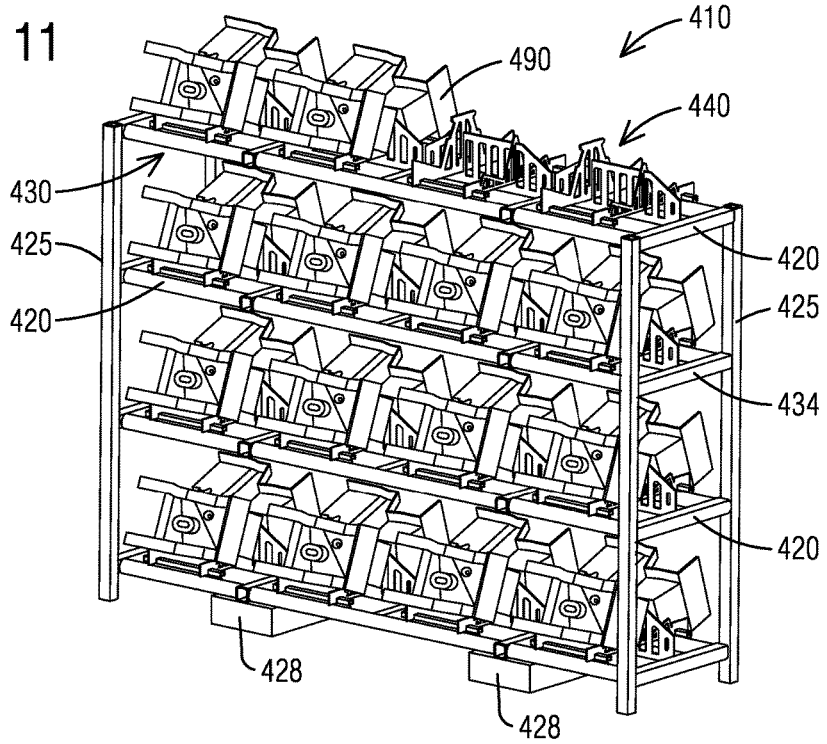
FIG. 11 is perspective view of a multi-level casting support system and castings, in accordance with yet another representative embodiment of the present disclosure.
Figure 12:
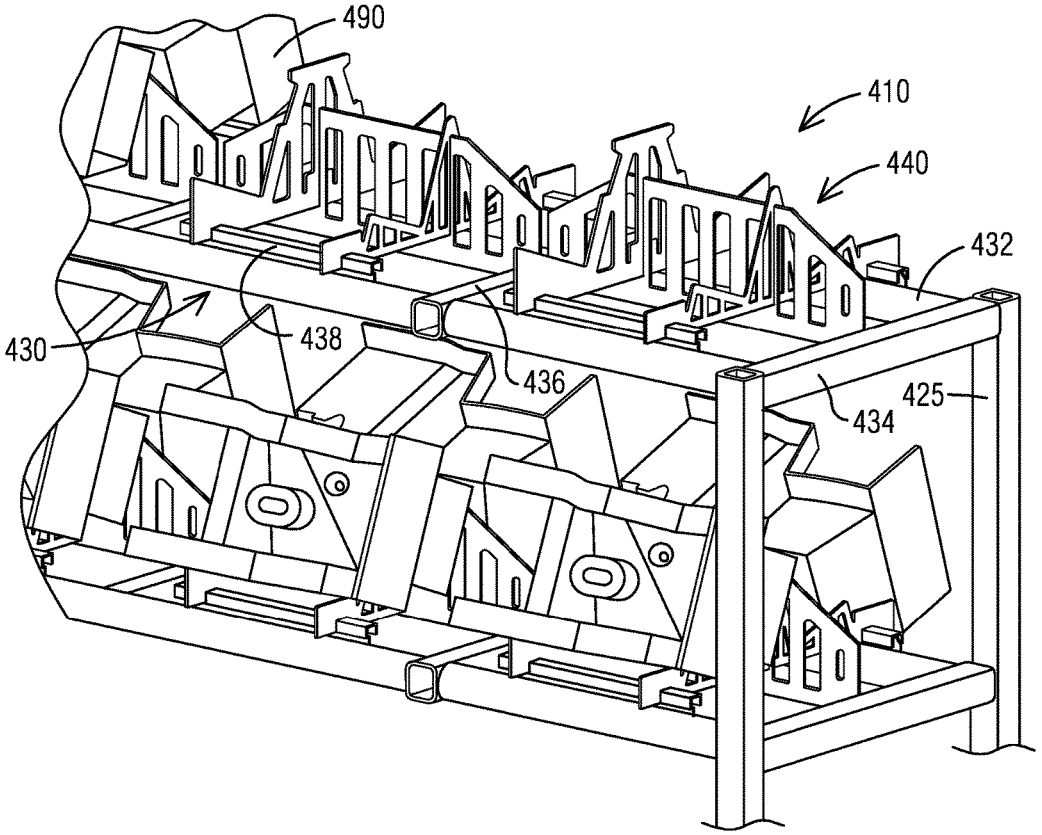
FIG. 12 is close-up perspective view of the multi-level casting support system and castings of FIG. 11.

In yet another embodiment of the casting support system 410 shown in FIGS. 11-12, the trays 420 that support the castings 490 can be stacked one above the others using risers 425 that, in one aspect, can be coupled to the end bars 434 of the perimeter frames 430. In this way multiple levels of castings 490 can be supported one above the other during one or more thermal treatments. This can greatly improve the speed and efficiency of the casting manufacturing process, especially for batch-type thermal treatment processes.

As shown in the drawings, the base trays 420 can be formed from the modular components similar to those described above, such as the side bars 432, end bars 434, crossbars 436, and mounting bars 438 that project upward from the upper surfaces of the side bars 432, and that together define a plurality of tray apertures 426 interior to the perimeter frames 430. The modular and interchangeable tray fixtures 440 formed from a plurality of support plates, such as the intersecting support plates 432, can be mounted to the trays 420 to extend over the tray openings 426, and to define polygonal-shaped flow areas for guiding thermal fluid upward from the tray openings to the underside surfaces of the castings. Due to the largely-open design of the stackable casting support system 410 that allows for the thermal fluids to readily flow between the rows the castings 490 in addition to flowing across or around nearly all of the surfaces of the individual castings, it will be appreciated that the casting support system 410 can facilitate uniform and evenly-applied thermal treatments that can also reduce the temperature gradients across rows of castings that have grouped together for one or more thermal treatments.

In addition, in one aspect each fixture 440 can be configured to support a plurality of castings 490, such as the set of HPDC aluminum alloy housings 492 shown in FIGS. 11-12.

The invention has been described herein in terms of preferred embodiments and methodologies considered by the inventor to represent the best mode of carrying out the invention. It will be understood by the skilled artisan, however, that a wide range of additions, deletions, and modifications, both subtle and gross, may be made to the illustrated and exemplary embodiments without departing from the spirit and scope of the invention. These and other revisions might be made by those of skill in the art without departing from the spirit and scope of the invention that is constrained only by the following claims.

The invention claimed is:

1. A system for supporting castings during thermal treatments including one or more of solution heat treatment, quenching and aging, the system comprising:

a tray defining a horizontal base plane and having a plurality of tray openings therethrough; and a fixture extending over at least one tray opening, the fixture comprising a plurality of support plates, each support plate of said plurality of support plates defining a lower portion extending across the at least one tray opening and a top edge extending above the at least one tray opening, the top edge having a shaped profile along the length thereof, the top edges of the plurality of support plates together defining an open support surface configured to loosely support a casting atop the open support surface and orientate the casting in space above the tray opening, wherein the top edge of each support plate of the plurality of support plates comprises at least a first edge-segment, a second edge-segment, and a third edge-segment, at least two adjacent ones of said edge-segments adjoining at a common point on said top edge and sloping downwardly from said common point, the first, second and third edge-segments having perpendicular bisectors that are not parallel to one another.

2. The system of claim 1, wherein each support plate intersects with at least one other support plate to form a lattice.

3. The system of claim 2, wherein the intersecting support plates further define a plurality of channels for guiding a flow of thermal fluid upward from the tray opening.

4. A system for supporting castings during thermal treatments including one or more of solution heat treatment, quenching and aging, the system comprising:

a tray defining a horizontal base plane and having a plurality of tray openings therethrough;

a fixture extending over at least one tray opening, the fixture comprising a plurality of support plates oriented vertically with lower portions extending across the at least one tray opening and top edges extending above the at least one tray opening with shaped profiles along the lengths thereof, the plurality of support plates forming an open lattice having a plurality of top edges that together define an open support surface configured to loosely support a casting atop the lattice and orientate the casting in space above the tray opening, wherein the plurality of support plates define a plurality of channels for guiding a flow of thermal fluid upward from the tray opening; and at least one deflector extending outward from a support plate for redirecting the flow of thermal fluid through a channel toward an opposing support plate.

5. The system of claim 1, wherein the ends of the support plates include upwardly extending projections.

6. The system of claim 5, wherein the upwardly extending projections include notches formed into the inside edges thereof.

7. The system of claim 1, wherein the tray is a first tray and the fixture is a first fixture, and wherein the system further comprises at least one additional tray having an additional fixture supported above the first tray and fixture to form a vertical rack for loosely supporting and aligning a plurality of castings in space above one another and the at least one tray opening.

8. A system for supporting castings during thermal treatments, the system comprising:

a tray including a perimeter frame having a pair of side bars joined together by a pair of end bars to define a horizontal base plane, and having at least one crossbar extending between the side bars intermediate the end bars to form a plurality of tray openings interior to the perimeter frame; and at least one fixture comprising a plurality of support plates oriented vertically with lower portions extending across a tray opening to engage at either end with the perimeter frame or with the at least one cross bar, and top edges extending above the tray opening with shaped profiles along the lengths thereof, with each of the plurality of support plates intersecting with at least one other support plate to form an open lattice having a plurality of top edges that together define an open support surface configured to loosely support the casting atop the lattice and align the casting in space above the tray opening.

9. The system of claim 8, wherein the top edge of each support plate of the plurality of support plates has a shaped profile along the length thereof that is neither a single straight line nor a single continuous curve.

10. The system of claim 8, wherein the intersecting support plates further define a plurality for guiding a flow of thermal fluid upward from the tray opening.

11. The system of claim 10, further comprising at least one deflector extending outward from a support plate for redirecting the flow of thermal fluid through a channel toward an opposing support plate.

12. The system of claim 7, further comprising apertures formed through the thickness of the support plates to allow a cross flow of a thermal fluid through the support plates.

13. The system of claim 12, wherein the apertures are elongated and substantially aligned with a vertical axis of the system.

14. The system of claim 8, wherein the ends of the support plates include upwardly extending projections.

15. The system of claim 14, wherein the upwardly extending projections include notches formed into inside edges thereof.

16. The system of claim 8, wherein the support plates are substantially aligned with the perimeter frame with lower edges that extend across a width or a length of the tray opening.

17. The system of claim 8, wherein the tray is made from a structural steel material and the support plates are made from a stainless steel material.

18. The system of claim 8, wherein the fixture is removably secured to the tray.

19. The system of claim 18, wherein the perimeter frame further includes mounting bars extending upward from the upper surfaces of the side bars and configured for engagement within complimentary notches formed into the lower edges of the support plates.

20. The system of claim 8, wherein the tray is a first tray and the fixture is a first fixture, and wherein the system further comprises at least one additional tray having at least one additional fixture supported above the first tray and at least one fixture to form a vertical rack for loosely supporting and aligning a plurality of castings in space above one another and the tray opening.

21. The system of claim 4, wherein each support plate intersects with at least one other support plate to form a lattice.

22. The system of claim 21, wherein the intersecting support plates divide the plurality of channels thus defining a greater number of channels within the plurality of channels.

23. The system of claim 1, further comprising apertures formed through the thickness of the support plates to allow a cross flow of a thermal fluid through the support plates.

24. The system of claim 8, further comprising apertures formed through the thickness of the support plates to allow a cross flow of a thermal fluid through the support plates.

* * * * *